US005529356A

United States Patent [19]

Cetnar

[11] Patent Number: 5,529,356

[45] Date of Patent: Jun. 25, 1996

[54] VEHICLE DOOR STRIKER WITH IMPROVED END PORTION

[75] Inventor: Roman Cetnar, Newmarket, Canada

[73] Assignee: Atoma International Inc., Markham, Canada

[21] Appl. No.: 249,247

[22] Filed: May 25, 1994

[51] Int. Cl.[6] ..... E05B 15/02

[52] U.S. Cl. ..... 292/340; 292/341.12

[58] Field of Search ..... 292/340, 341.12, 292/DIG. 73, DIG. 38, 198, DIG. 56

[56] References Cited

U.S. PATENT DOCUMENTS

| | | | |
|---|---|---|---|
| 4,466,645 | 8/1984 | Kobayashi | 292/341.12 |
| 4,470,626 | 9/1984 | Gergoe et al. | 292/341.12 |
| 4,733,892 | 3/1988 | Kleefeldt et al. | 292/341.12 X |
| 4,981,313 | 1/1991 | Makamura | 292/340 |
| 5,209,531 | 5/1993 | Thau | 292/340 X |
| 5,209,532 | 5/1993 | Nakamura et al. | 292/340 X |
| 5,215,342 | 6/1993 | Yugi et al. | 292/340 |
| 5,382,062 | 1/1995 | Kostler | 292/340 |

FOREIGN PATENT DOCUMENTS

3240532C2 3/1984 Germany .

*Primary Examiner*—Steven N. Meyers
*Assistant Examiner*—Monica E. Millner
*Attorney, Agent, or Firm*—Cushman, Darby & Cushman

[57] ABSTRACT

A striker assembly for a vehicle door opening comprising a base member having a central embossed portion provided with mounting holes and fastener receiving holes above and below the embossed portion and a striker member having mounting elements extending rearwardly therefrom constructed and arranged to pass through the mounting holes with free ends deformed to extend over the embossed portion to fixedly retain the striker member to the base member. The striker member has a mounting portion, a post portion extending from the mounting portion, a connecting portion extending from the end of the post portion in generally parallel relation to the mounting portion defining a latch receiving opening and an inner end portion. Preferably, the striker assembly is mounted by resilient material adhered between the interior surfaces of a mounting member and the exterior surfaces of the base member disposed therein to thereby resiliently cushion the tendency of the striker member fixed to said base member and extending outwardly of the mounting member to be moved in any direction during operation.

10 Claims, 3 Drawing Sheets

VEHICLE DOOR STRIKER WITH IMPROVED END PORTION

This invention relates to vehicle door latching hardware and more particularly to an improved striker assembly.

The typical striker assembly utilized in automotive vehicles is a so-called wire loop type striker which consists of a base plate and a U-shaped heavy wire or rod having its free ends fixed to the base plate. The wire loop type striker is mounted on the sheet metal defining the door opening by a pair of fasteners extending through the base plate and fixed to the metal so that the wire loop extends forwardly. The U-shaped rod presents the opening within which the door latch moves when the door is closed. The leg of the U-shaped rod which is toward the exterior of the vehicle is the one which strikes the latching mechanism as the door is being closed to move the latch into its latched position. The other leg is positioned to enter the wedge-shaped opening through which the outermost leg passes. A problem which is presented with the wire loop type striker is that the entire U-shaped rod is disposed within the wedge-shaped opening of the door when the door is in its closed position. Consequently, during a crash, the interior structure of the door can be displaced inwardly behind the inner leg of the U-shaped member, thus preventing the door from opening after the crash.

Another type of striker which has cured the problem encountered above with the wire loop type striker consists essentially of an L-shaped base plate connected with the ends of an L-shaped rod. With this construction, one leg of the L-shaped base member is fixed by fasteners to the metal defining the door opening with the other leg extending in the area which is to the interior of the door when it is closed. The free ends of the L-shaped rod are fixed to the legs of the base member so that one leg of the L-shaped rod strikes the latch member. With this configuration, the position of the other leg of the L-shaped rod and the leg of the base plate which is connected thereto is such as to prevent any portion of the interior door structure from moving inwardly behind the striker. This construction therefore obviates the problem of the door being incapable of being opened after the crash. On the other hand, since the only structure of this striker which is within the wedge-shaped opening provided by the structure of the latch mechanism at the rear surface of the door is the single leg of the L-shaped rod, there is presented the possibility that the leg of the L-shaped base member which extends forwardly can move relatively to the latch mechanism during a crash into a position that possibly could cause the latch mechanism to open during the crash.

An object of the present invention is the provision of latching hardware for a vehicle door including a striker assembly which obtains the advantages of both of the above-mentioned types of striker assemblies while eliminating the disadvantages of each.

In accordance with the principles of the present invention, this objective is obtained by providing latching hardware for latching a movable vehicle door in a closed position within a door opening defined by vehicle structure including a peripheral portion having a transverse extent to confront a thickness of the door and a flange-like portion having a longitudinal extent to confront in transversely spaced relation a marginal edge of an interior side of the vehicle door. The vehicle door has a recess formed in a peripheral portion thereof which extends (1) transversely from a closed end to an open end facing toward and confronting in spaced relation the flange-like portion when the vehicle door is in the closed position and (2) longitudinally from a closed side to an open side facing toward the peripheral portion of the vehicle structure when the vehicle door is in the closed position. The latching hardware comprises a latching mechanism for mounting on the vehicle door and a cooperating striker assembly for mounting on the vehicle structure. The latching mechanism includes a movable latching component constructed and arranged to be moved from an inoperative position into a latching position extending across a central portion of the door recess between a closed end portion thereof and an open end portion thereof in response to the movement of the vehicle door into the closed position thereof. The striker assembly includes a base member and a striker member fixedly secured to the base member. The base member is adapted to be fixedly secured to the peripheral portion of the vehicle structure defining the door opening in a position to dispose the striker portion within the door recess when the vehicle door is in its closed position. The striker member includes a mounting portion fixed to the base member, an outer post portion extending forwardly from the mounting portion in a position to extend within the closed end portion of the door recess when the vehicle door is in the closed position, a spaced post portion extending forwardly from the mounting portion in a position to extend within the open end portion of the door recess when the vehicle door is in the closed position, and a connecting portion rigidly interconnecting the outer and spaced post portions in a position to extend within a closed side portion of the recess when the vehicle door is in the closed position so as to define with the outer and spaced post portions and the mounting portion an opening disposed within the central portion of the door recess when the vehicle door is in the closed position for receiving the movable latching component therethrough when moved from its inoperative position into its latching position. The connecting portion extends transversely beyond the spaced post portion so as to present an inner end portion disposed adjacent the flange-like portion transversely beyond the open end of the recess when the vehicle door is in the closed position.

Another object of the present invention is to provide a striker assembly which is more cost effective than striker assemblies heretofore proposed. This objective is obtained by providing a striker assembly for securement to a vehicle door opening so as to cooperate with a latch mechanism mounted within a rear edge of a door for closing the door opening. The striker includes a base member formed as a sheet metal stamping adapted to be mounted in a generally vertically disposed forwardly facing operative position within a rear of the vehicle door opening by fasteners extending through a pair of fastener receiving openings extending generally horizontally through the base member. The base member has a central embossed portion provided with a pair of generally horizontally spaced mounting holes extending from a forwardly facing surface rearwardly to an opposite surface of the central embossed portion. A striker member is formed as a sheet metal stamping providing an operatively rearwardly facing surface having a pair of mounting elements extending rearwardly therefrom constructed and arranged to pass through the mounting holes with free ends extending beyond the opposite surface of the base member. The free ends are deformed to extend over the opposite surface of the central embossed portion to fixedly retain the operatively rearwardly facing surface of the striker member in engagement with the forwardly facing surface of the central embossed portion of the base member. The striker member has a latch receiving opening struck therefrom in forwardly spaced relation to the rearwardly facing surface so as to provide a mounting portion which includes the rearwardly facing surface, a post portion rounded by coining extending operatively forwardly from the vehicle exterior side of the mounting portion, a connecting portion extending from the forward end of the post portion in generally parallel relation to the mounting portion and an inner end portion extending from the vehicle interior side of the mounting portion to the connecting portion.

Another object of the present invention is to provide a striker assembly in which the striker component which interengages with the latching mechanism is mounted with respect to the frame defining the door opening in such a way as to cushion the tendency of the striker component to be moved in any direction. In accordance with the principles of the present invention, this objective is obtained by providing a striker assembly for securement to a vehicle door opening so as to cooperate with a latch mechanism mounted within a rear edge of a door for closing the door opening. The striker assembly comprises a rigid base and striker structure including a striker portion providing a striker latch receiving opening disposed operatively in a forward vertically extending relation and a base portion having a plurality of base mounting holes disposed operatively in rearward horizontally extending relation above and below the striker latch receiving opening. A mounting member includes a central aperture wall having a rim wall portion extending operatively rearwardly therefrom and a plurality of fastener receiving openings defined by annular wall portions extending rearwardly from the centrally apertured wall above and below the central aperture thereof. The central apertured wall and wall portions of the mounting member have interior surfaces within which the base portion is mounted with the striker portion extending forwardly from the central aperture of the mounting member. The base portion is disposed within the interior space in spaced relation with the interior surfaces of each mounting member with the base mounting holes receiving the annular wall portions in spaced relation therethrough so as to leave a residual spacewithin the interior space in adhered relation to the interior surfaces of the mounting member and the exterior surfaces of the base portion with the interior space to thereby resiliently cushion the tendency of the base and striker structure to be moved in any direction.

These and other objects of the present invention will become more apparent during the course of the following detailed description and appended claims.

The invention may best be understood with reference to the accompanying drawings wherein an illustrative embodiment is shown.

Figure 1:
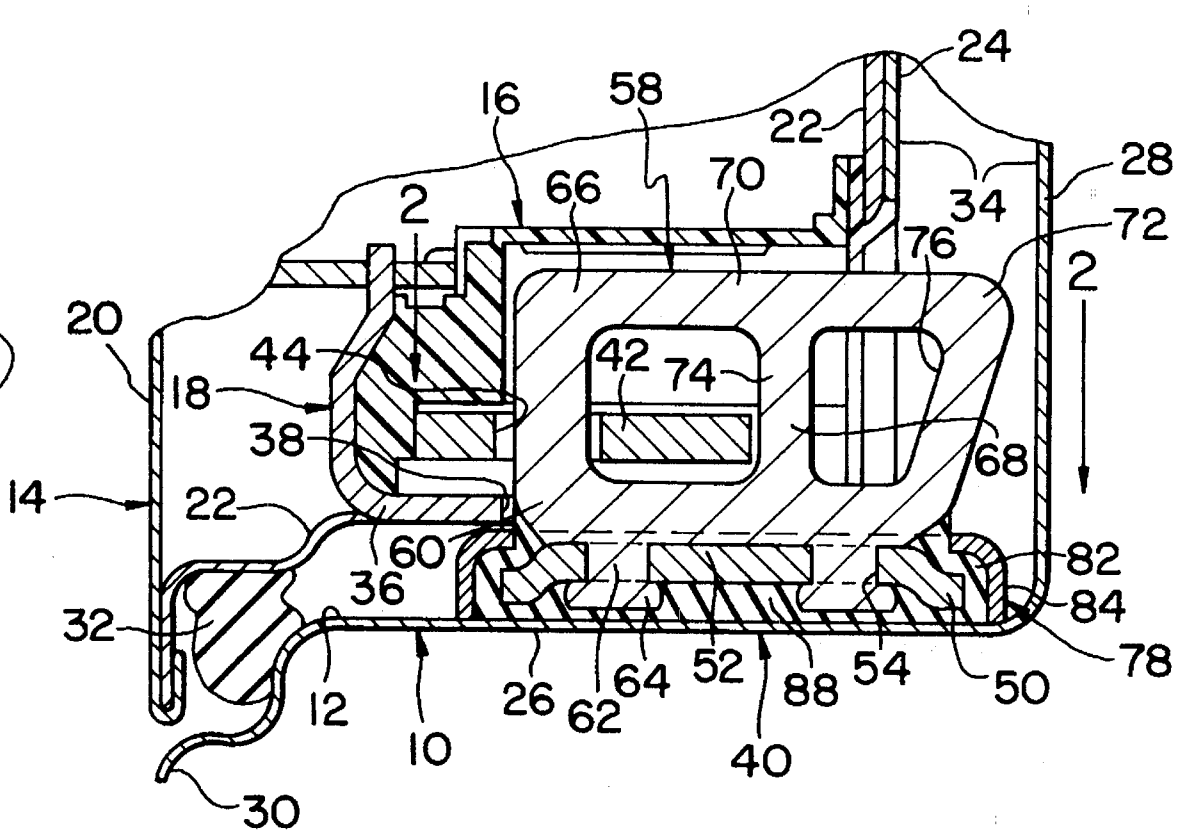
FIG. 1 is a fragmentary horizontal sectional view of the rear end of a vehicle door in closed relation within the vehicle opening, showing latching hardware constructed in accordance with the principles of the present invention.
Figure 4:
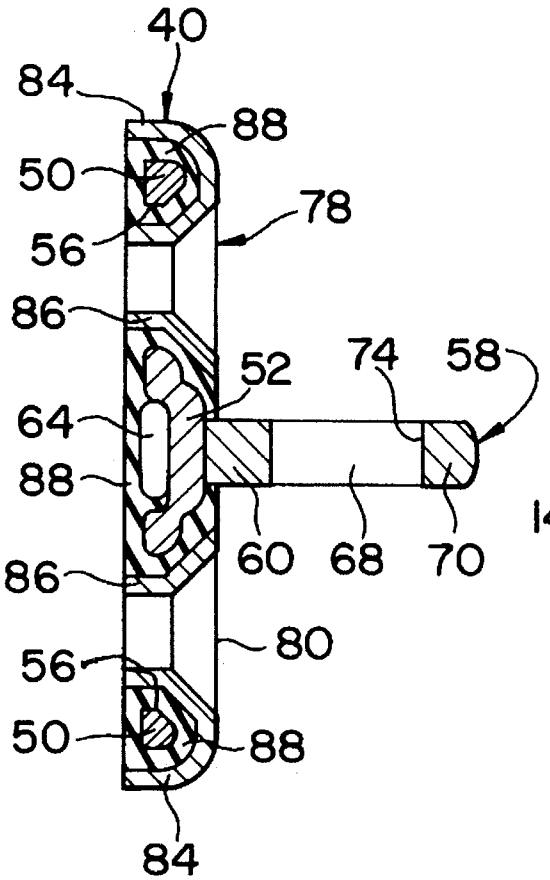
FIG. 4 is a cross-sectional view taken along the line 4—4 of FIG. 3.

Referring now more particularly to the drawings, there is shown in FIG. 1 thereof a sheet metal part, generally indicated at 10, of a vehicle body defining the rearward boundary of a door opening 12 therein, the rear portion of a door assembly, generally indicated at 14, disposed in closed relation with the opening 12 and latching hardware, generally indicated at 16, embodying the principles of the present invention mounted in the door assembly 14 and the sheet metal part 10 defining the door opening 12, respectively.

The latching hardware 16 includes a conventional latching mechanism, generally indicated at 18, which is mounted within a recess formed in the rear of the door assembly 14. As shown, the door assembly 14 includes an exterior sheet metal panel or skin 20 interconnected with interior skeletonized sheet metal 22 defining the door rim. The inner surface of the door assembly 14 is provided by a panel, schematically indicated at 24, covering the interior sheet metal inwardly of the door rim.

The sheet metal part 10 of the vehicle body defining the rearward portion of the door opening 12 shown in the drawings includes a peripheral portion 26 defining the thickness of the opening 12, a forwardly extending inner portion 28 and a rearwardly extending outer portion 30. As shown, when the door assembly 14 is disposed in closed relation with the door opening 12, a seal 32 carried by the door assembly 14 engages the rearwardly extending portion 30 of the sheet metal part 10 of the vehicle body. It will also be noted that the inner panel 24 of the door assembly 14 is spaced from the forwardly extending inner portion 28 of the vehicle body sheet metal part 10 so as to provide ample clearance therebetween, as indicated at 34. All of this is in accordance with conventional construction.

Figure 2:
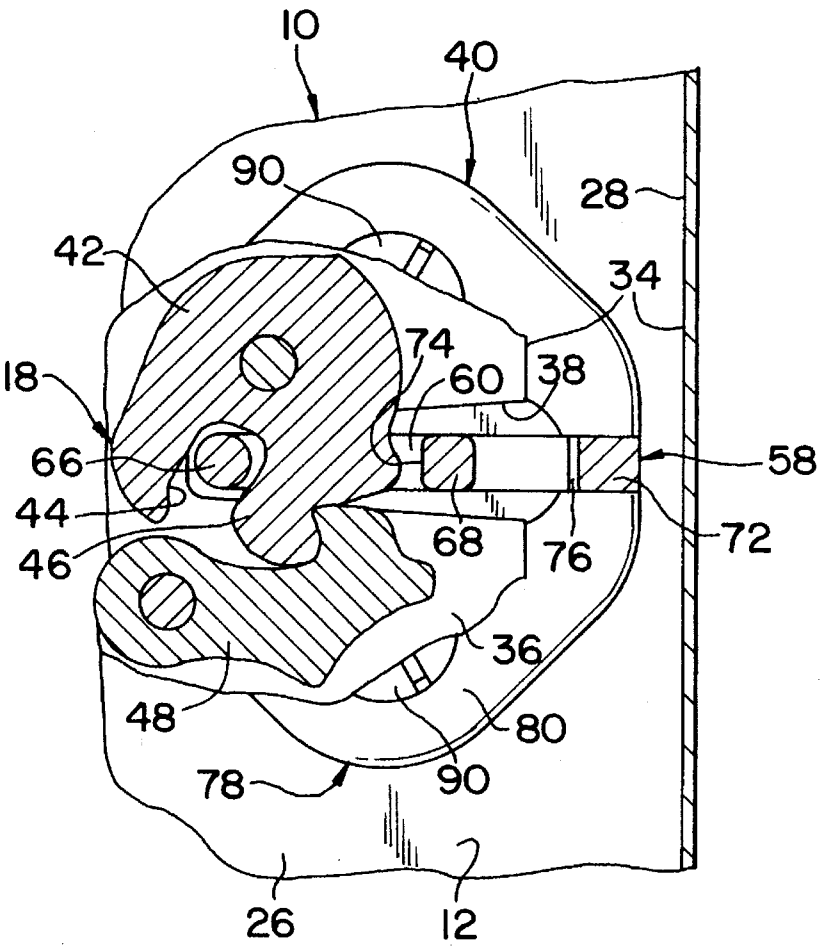
FIG. 2 is a fragmentary sectional view taken along the line 2—2 of FIG. 1.
Figure 3:
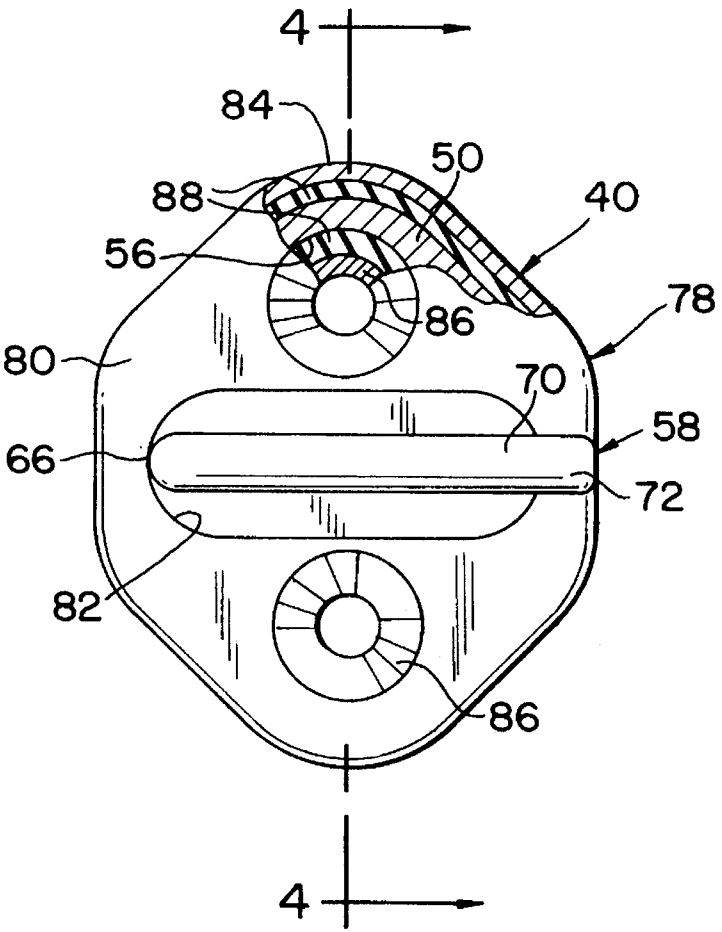
FIG. 3 is an elevational view of the striker assembly, partly in section, viewed in a direction looking rearwardly in relation to the position in which the striker assembly is mounted within the vehicle door opening.

Within a recess in the rearward periphery of the door assembly 14, the latching mechanism 18 is mounted. The latching mechanism 18 includes a rearward housing plate 36 having a V-shaped opening or recess 38 therein which serves to receive a striker assembly, generally indicated at 40, constituting the part of the latching hardware 16 fixed within the door opening 12. The latching mechanism 18 includes a latch component 42 of conventional construction which is spring-biased into an open position enabling the striker assembly 40 to move within a recess 44 in the latch component 42 which forms a final latch element 46 capable of entering the striker assembly and cooperating with a locking pawl 48. The locking pawl 48 is mounted alongside the latch component 42 and is also spring-biased to pivot in a counterclockwise direction as viewed in FIG. 2.

When the latching mechanism 18 is in its open position, the recess 44 in the latch component 44 faces inwardly in the direction in which the V-shaped notch 38 in plate 36 faces so as to allow the striker assembly 40 relatively to enter therein. As the door assembly 14 is closed, the striker assembly 40 engages the latch component 42 and serves to move the same pivotally, against the spring bias, in a clockwise direction as viewed in FIG. 2. The movement of the latch component 42 causes the locking pawl 48 to move under the action of its spring-bias first into the recess 44 and then into a locking position behind the latch element 46 so as to lock the door assembly 14 in its closed position. The latching mechanism 18 also includes conventional components (not shown) which enable the locking pawl 48 to be moved against its spring-bias into a release position by actuating either an exterior handle assembly (not shown) or an interior handle assembly (not shown). Usually, the latching mechanism 18 also includes a locking mechanism (not shown) which is moved between a locking position preventing the locking pawl 48 from being moved out of its locking position and an unlocking position which will enable the locking pawl 48 to be moved out of its locking position.

The striker assembly 40, which is constructed in accordance with the principles of the present invention, includes a base member 50 which is preferably stamped from sheet metal stock. As shown, the base member 50 is formed with a central embossed portion 52 having a pair of openings 54 extending therethrough. In the normal operative position of the base member 50, the central embossed portion 52 is elongated in a horizontal direction and the base member 50 also includes a pair of fastener receiving openings 56 disposed above and below the central embossed portion 52.

The striker assembly 40 also includes a striker member, generally indicated at 58, which likewise is stamped from sheet metal stock. The striker member 58 includes an elongated mounting portion 60 having a pair of spaced mounting elements in the form of projections 62 extending rearwardly from a rearward surface thereof. The projections 62 are spaced apart a distance to pass rearwardly through the openings 54 in the embossed portion 52 of the base member 50 so that ends of the projections 62 extend rearwardly beyond the adjacent rear surface of the embossed portion 52. The ends of the projections 62 are then deformed, as indicated at 64, so as to engage the rearwardly facing surface of the embossed portion 52. In this way, the striker member 58 is fixedly secured to the base member 50 with the rearwardly facing surface of the mounting portion 60 engaging the forwardly facing surface of the embossed portion 52 of the base member 50.

The striker member 58 also includes an outer post portion 66 which extends from the end of the mounting portion 60 which faces the exterior of the vehicle when the striker assembly 40 is mounted in operative position. The striker member 58 is preferably made on a multi-stage stamping machine in which one or more stages serve to coin the outer post portion 66 into a generally round cross-sectional configuration. In operation, the outer post portion 66 enters the recess 44 of the latch component 42 and moves the latter so there is a relative turning movement between the outer post portion 66 within the recess 44 and, hence, the need for its circular cross-sectional configuration.

The striker member 58 also includes a second spaced post portion 68 extending forwardly from the forward surface of the mounting portion 60 in a position to be disposed within the door recess 38. The striker member 58 also includes a connecting portion 70 which extends from the post portion 66 to the spaced post portion 68 and an end portion 72 which extends beyond the connecting portion 70. The two post portions 66 and 68 and the extent of the mounting portion 60 and connecting portion 70 extending therebetween define a struck opening 74 in the striker member 58 for receiving the latch element 46 of the latch component 42 in operation. Preferably, the end portion 72 is formed with a second opening 76 defined between spaced post portion 68, end portion 72, mounting portion 60, and an inner post portion 73.

It will be noted that the end portion 72 is disposed, when the door assembly 14 is in its closed relation, in a direction away from the door recess 38 so as to be disposed within the clearance space 34. Thus, the end portion 72 prevents the inner panel 24 of the door assembly 14 from being displaced relatively behind the striker member 58 in the event of an accident. Moreover, the position of the second post portion 68 within the door recess 38 limits the relative angular movement that can occur between the striker member 58 and the latch mechanism 18 during a crash.

In the preferred embodiment of the striker assembly 40 shown in FIGS. 1–4, the combined base member 50 and striker member 58 structure, which is essentially a single fixed structure, is mounted within a mounting member, generally indicated at 78. The mounting member is also preferably stamped from sheet metal stock and includes a main wall 80 which is centrally apertured, as indicated at 82, and includes a rearwardly bent peripheral wall portion 84 which extends throughout the periphery thereof. Formed above and below the central aperture 82 is a pair of fastener receiving annular wall portions 86.

In the preferred embodiment shown in FIGS. 1–4, the peripheral wall portion 84 is of a size sufficient to receive the base member 50 in spaced relation therein with the annular wall portions 86 extending through the openings 56 in the base member 50 also in spaced relation. The mounting of the combined base and striker structure within the mounting member 78 is completed by molding a body of resilient material 88 within the residual space between the interior surface of the mounting member and the exterior surface of the base member 50 with the striker member 58 extending forwardly of the central opening 82 in the mounting member 78.

When the striker member is assembled on the wall portion 26 of the sheet metal part 10 defining door opening 12, fasteners 90 (see FIG. 2) extend through the annular wall portions 86 and are fixed within the vehicle body defining the door opening 12. It will be understood that the fasteners 90 consequently extend not only through the mounting member 78 but also through the openings 56 in the base member 50. Since the base member 50 is held within the interior of the mounting member 78 by the resilient-material 88 which adheres to both the interior surface of the mounting member 78 and the exterior surface of the base member 50, the base member 50 and hence the striker member 58 fixed thereto are retained within the mounting member 78 in a manner which will cushion the movements of the striker member 58 in any direction.

Figure 5:
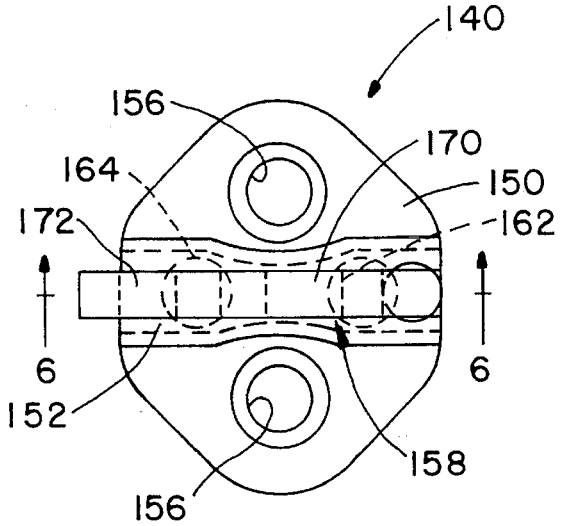
FIG. 5 is a elevational view similar to FIG. 3 of another form of striker assembly embodying the principles of the present invention disposed in a position for mounting in the opposite door opening.
Figure 6:
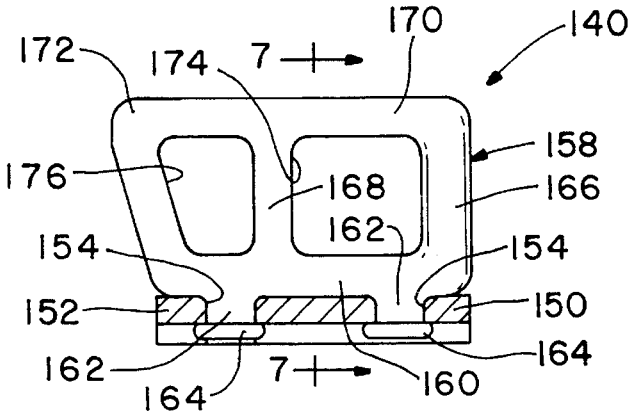
FIG. 6 is a view showing the base member in section taken along the line 6—6 of FIG. 5 and the striker member in elevation.
Figure 7:
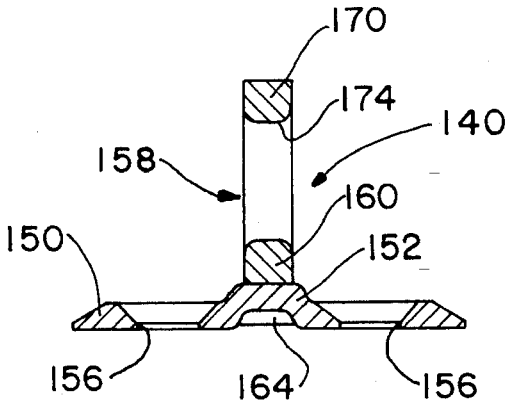
FIG. 7 is a sectional view taken along the line 7—7 of FIG. 6.

Referring now more particularly to FIGS. 5–7, there is shown therein a modified form of striker assembly, generally indicated at 140, which embodies the principles of the present invention. The striker assembly 140 is essentially similar to the striker assembly 40 previously described except that the assembly is mounted in a rigid fashion to the vehicle body part 10 rather than by means of a mounting member 78 and body of resilient material 88 for cushioning the tendency of the striker assembly to be moved in any direction during operation.

As shown, the striker assembly 140 includes a base member 150 having a central embossed portion 152 provided with a pair of openings 154 and fastener receiving openings 156 above and below the horizontally extending embossed portion 152. The striker assembly 140 also includes a striker member 158 which includes mounting portion 160 having projections 162 which extend through the openings 154 with ends thereof being deformed, as indicated at 164, into engagement within the embossed portion 152 to fixedly mount the mounting portion 160 thereon. The striker member 178 also includes a first post portion 166 of generally circular cross-section, a spaced second post portion 168, connecting portion 170, an inner post portion 173, and an end portion 172. As before, the striker member has struck therefrom latch element receiving opening 174 and a second opening formed in the end part 176. It will be understood that, in the installation of the striker assembly 140, the fasteners extend through the openings 156 and serve to directly fixedly attach the base member to the portion 26 of the sheet metal part 10.

It thus will be seen that the objects of this invention have been fully and effectively accomplished. It will be realized, however, that the foregoing preferred specific embodiment has been shown and described for the purpose of this invention and is subject to change without departure from such principles. Therefore, this invention includes all modifications encompassed within the spirit and scope of the following claims.

What is claimed is:

1. A striker assembly in combination with a vehicle door opening and cooperating with a latch mechanism mounted within a rear edge of a door, closing the door opening, said latch mechanism including a transverse recess said striker comprising:

a base member formed as a sheet metal stamping mounted in a generally vertically disposed forwardly facing operative position within a rear of the vehicle door opening by fasteners extending through a pair of fastener receiving openings extending generally horizontally through said base member;

said base member having a central embossed portion provided with a pair of generally horizontally spaced mounting holes extending from a forwardly facing surface rearwardly to an opposite surface of said central embossed portion;

a striker member formed as a sheet metal stamping providing an operatively rearwardly facing surface having a pair of mounting elements extending rearwardly therefrom constructed and arranged to pass through said mounting holes with free ends extending beyond the opposite surface of said base member;

said free ends being deformed to extend over the opposite surface of the central embossed portion to fixedly retain the operatively rearwardly facing surface of the striker member in engagement with the forwardly facing surface of the central embossed portion of said base member;

said striker member having a latch receiving opening struck therefrom in forwardly spaced relation to said rearwardly facing surface so as to provide a mounting portion which includes said rearwardly facing surface, an outer post portion rounded by coining extending operatively forwardly from the vehicle exterior side of said mounting portion, a connecting portion extending from the forward end of the post portion in generally parallel relation to said mounting portion and an intermediate post portion extending from an intermediate segment of said mounting portion to said connecting portion said outer post and said intermediate post being disposed in said recess when said door is in a closed position said striker assembly further having a second opening spaced from said first mentioned opening by said intermediate post portion and defined by said intermediate post portion, an inner post portion and the extent of said mounting portion and said connecting portion between said inner post portion and said intermediate post portion said second opening extending out of said recess when said door is in said closed position.

2. A striker assembly as defined in claim 1, wherein said fixedly interconnected striker member and base member are mounted by resilient material within a mounting member, said mounting member being formed as a stamping providing a centrally apertured wall having a central aperture, a rearwardly bent rim wall portion extending from a periphery thereof and a plurality of fastener receiving openings defined by annular wall portions extending rearwardly from said centrally apertured wall on opposite sides of the central aperture thereof;

the centrally apertured wall and the rim and annular wall portions of said mounting member having interior surfaces defining an interior space within which said base member is disposed with said striker member extending forwardly from the central aperture thereof;

the base member having an exterior surface confronting in spaced relation said interior surfaces with the mounting holes of the base receiving said annular wall portions in spaced relation therethrough so as to leave a residual space within said interior space, said resilient material being constructed and arranged to generally fill said residual space in adhered relation to the interior surfaces of the mounting member and the exterior surfaces of the base member within said interior space to thereby resiliently cushion the tendency of the striker member fixed to said base member to be moved in any direction.

3. A striker assembly in combination with a vehicle door opening and cooperating with a latch mechanism mounted within a rear edge of a door closing the door opening, said latch mechanism including a transverse recess said striker assembly comprising:

a rigid base and striker structure including a striker portion providing a striker latch receiving opening defined in said striker member by a mounting portion, an outer post portion extending forwardly from said mounting portion, a connecting portion extending from said outer post portion in generally parallel relation to said mounting portion and an intermediate post portion extending between said connecting portion and said mounting portion said outer post portion and said intermediate post portion being disposed in said recess when said door is in a closed position, and a second opening spaced from said striker latch receiving opening by said intermediate post portion and defined by said intermediate post portion, an inner post portion and the extent of said mounting portion and said connecting portion between said inner post portion and said intermediate post portion, said second opening extending out of said recess when said door is in said closed position, said striker latch receiving opening and said second opening being disposed operatively in a forward vertically extending relation and a base portion having a plurality of base mounting holes disposed operatively in rearward horizontally extending relation above and below said striker latch receiving opening;

a mounting member including a centrally apertured wall having a central aperture, a rim wall portion extending operatively rearwardly therefrom and a plurality of fastener receiving openings defined by annular wall portions extending rearwardly from said centrally apertured wall above and below the central aperture thereof;

the centrally apertured wall and the rim and annular wall portions of said mounting member having interior surfaces within which the base portion is mounted with the striker portion extending forwardly from the central aperture of said mounting member;

the base portion having exterior surfaces and being disposed within said interior space in spaced relation with said interior surfaces of each mounting member with the base mounting holes receiving said annular wall portions in spaced relation therethrough so as to leave a residual space within said interior space wherein said residual space is filled with a resilient material constructed and arranged to generally fill said residual space in adhered relation to the interior surfaces of the mounting member and the exterior surfaces of the base portion within said interior space to thereby resiliently cushion the tendency of said base and striker structure to be moved in any direction.

4. A striker assembly as defined in claim 3 wherein the base portion and striker portion of said base and striker structure are provided by separate base and striker members fixed together.

5. A striker assembly as defined in claim 4 wherein said separate base and striker members are each stamped from sheet metal.

6. A striker assembly as defined in claim 4 wherein said striker member includes a pair of spaced integral mounting projections extending rearwardly from said mounting portion, said base member having a central embossed portion provided with a pair of projection receiving openings therein receiving said mounting projections rearwardly therethrough so that said projections have ends extending beyond said projection receiving openings, said projection ends being deformed into engagement with the central embossed portion of said base member to fixedly retain said striker member on said base member.

7. A striker assembly for securement to a vehicle door opening so as to cooperate with a latch mechanism mounted within a rear edge of a door for closing the door opening, said striker comprising a base member formed as a sheet metal stamping adapted to be mounted in a generally vertically disposed forwardly facing operative position within a rear of the vehicle door opening by fasteners extending through a pair of fastener receiving openings extending generally horizontally through said base member, said base member having a central embossed portion provided with a pair of generally horizontally spaced mounting holes extending from a forwardly facing surface rearwardly to an opposite surface of said central embossed portion, and a striker member integrally formed as a sheet metal stamping providing an operatively rearwardly facing surface having a pair of mounting elements extending rearwardly therefrom constructed and arranged to pass through said mounting holes with free ends extending beyond the opposite surface of said base member, said free ends being deformed to extend over the opposite surface of the central embossed portion to fixedly retain the operatively rearwardly facing surface of the striker member in engagement with the forwardly facing surface of the central embossed portion of said base member, said striker member having a latch receiving opening stamped therethrough in forwardly spaced relation to said rearwardly facing surface so as to provide a mounting portion which includes said rearwardly facing surface and which extends between said pair of mounting elements, a poet portion rounded by coining extending operatively forwardly from the vehicle exterior side of said mounting portion, a connecting portion extending from the forward end of the post portion in generally parallel relation to said mounting portion and an inner end portion extending from the vehicle interior side of said mounting portion to said connecting portion.

8. A striker assembly as defined in claim 7 wherein said fixedly interconnected striker member and base member are mounted by resilient material within a mounting member, said mounting member being formed as a stamping providing a centrally apertured wall having a rearwardly bent rim wall portion extending from a periphery thereof and a plurality of fastener receiving openings defined by annular wall portions extending rearwardly from said centrally apertured wall on opposite sides of the central aperture thereof, the centrally apertured wall and wall portions of said mounting member having interior surfaces defining an interior space within which said base member is disposed with said striker member extending forwardly from the central aperture thereof, the base member being disposed in spaced relation to said interior surfaces with the mounting holes thereof receiving said annular wall portions in spaced relation therethrough so as to leave a residual space within said interior space, said resilient material being constructed and arranged to generally fill said residual space in adhered relation to the interior surfaces of the mounting member and the exterior surfaces of the base member within said interior space to thereby resiliently cushion the tendency of the striker member fixed to said base member to be moved in any direction.

9. A striker assembly as defined in claim 8 wherein the inner end portion of said striker member is formed with a second opening spaced from said first mentioned opening by an intermediate poet portion and defined by said intermediate post portion, an inner poet portion and the extent of said mounting portion and said connecting portion between said inner post portion and said intermediate post portion.

10. A striker assembly as defined in claim 7 wherein the inner end portion of said striker member is formed with a second opening spaced from said first mentioned opening by an intermediate poet portion and defined by said intermediate poet portion, an inner post portion and the extent of said mounting portion and said connecting portion between said inner post portion and said intermediate post portion.

* * * * *